United States Patent [19]

Miura

[11] Patent Number: 4,742,186

[45] Date of Patent: May 3, 1988

[54] SWITCH DEVICE WITH INTERLOCKING SLIDE

[75] Inventor: Teiichi Miura, Furukawa, Japan

[73] Assignee: Alps Electric Co., Ltd., Japan

[21] Appl. No.: 861,687

[22] Filed: May 9, 1986

[30] Foreign Application Priority Data

May 9, 1985 [JP] Japan ..... 60-68333[U]

[51] Int. Cl.[4] ..... H01H 9/20

[52] U.S. Cl. ..... 200/5 E; 200/50 C

[58] Field of Search ..... 74/483 PB; 200/5 B, 200/5 C, 5 E, 5 EA, 5 EB, 50 C, 153 J, 328

[56] References Cited

U.S. PATENT DOCUMENTS

Re. 27,836 12/1933 Hansen ..... 200/5 EB 3,544,739 12/1970 Shah ..... 200/5 E 3,783,204 1/1974 Kennedy et al. ..... 200/5 EB 4,297,540 10/1981 Tsutsui et al. ..... 74/483 PB X 4,309,579 1/1982 Kondo et al. ..... 74/483 PB X

*Primary Examiner*—J. R. Scott

*Attorney, Agent, or Firm*—Guy W. Shoup

[57] ABSTRACT

A slide for an interlocking switch device which can reduce the thickness and simplify the structure thereof by reducing the thickness of material of components without changing the height. The slide has an interlocking cam operating portion and a simultaneous locking inhibiting member controlling portion formed in a spaced relationship by a fixed distance from each other on a wall face of the slide. In a plural switch unit array, only one switch is operable at a time.

5 Claims, 2 Drawing Sheets

SWITCH DEVICE WITH INTERLOCKING SLIDE

BACKGROUND OF THE INVENTION

This invention relates to a structure of a slide for an interlocking switch device having a simultaneous locking inhibiting mechanism.

Conventionally, a slide of an interlocking switch device of the type described above has an operating portion for an interlocking cam formed on a front face thereof and a cam operating portion for a simultaneous locking inhibiting cam formed separately on a rear face thereof because of a limitation in height of the switch.

However, in a structure of the conventional slide, it is inevitable that the thickness or size in a back and forth direction be great, and because there exist cam mechanisms on opposite faces thereof, it is difficult to produce the slide by molding, and besides an interlocking mechanism for interlocking operations of such mechanisms is complicated.

SUMMARY OF THE INVENTION

It is an object of the present invention to provide a slide for an interlocking switch device which eliminates such problems of the prior art device as described above and can reduce the thickness and simplify the structure thereof by reducing the thickness of material of components without changing the height thereof.

In order to attain the object, according to the present invention, a slide for an interlocking switch device is characterized in that an interlocking cam operating portion and a controlling portion for controlling a simultaneous locking inhibiting member are formed in a spaced relationship by a fixed distance from each other on a wall face of the slide.

DETAILED DESCRIPTION OF THE PREFERRED EMBODIMENT

Figure 1:
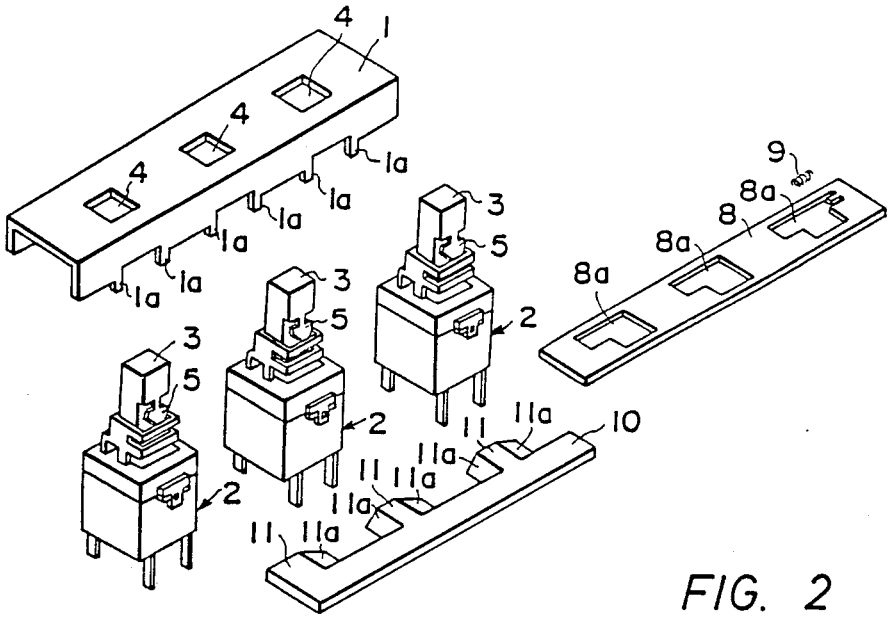
FIG. 1 is a fragmentary perspective view of an interlocking switch device embodying the present invention.
Figure 2:
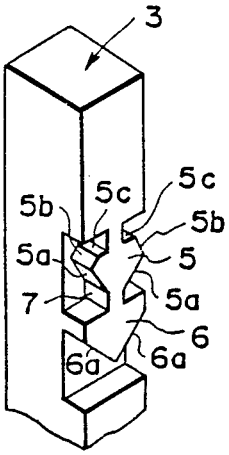
FIG. 2 is a perspective view of essential part of a slide of the switch device of FIG. 1.

Now, a preferred embodiment of the present invention will be described with reference to the accompanying drawing.

An interlocking switch device includes a chassis 1 which has a plurality of insertion holes 4 perforated therein. A plurality of switches 2 are secured to the chassis 1 by caulking at caulking portions 1*a* thereof and have heads which extend through the insertion holes 4 in the chassis 1.

Each of the slides 3 has formed on a front face thereof an operating portion 5 for an interlocking cam 8 which will be hereinafter described and a controlling portion 6 for a simultaneous locking inhibiting member 10. The interlocking cam operation portion 5 has a pair of tapered lowering guide faces 5*a*, a pair of tapered rising guide faces 5*b*, and a pair of horizontal stopping faces 5*c* contiguous to the tapered rising guide faces 5*b*. Meanwhile, the controlling portion 6 is formed in a spaced relationship by a fixed distance with an intervening connecting portion 7 below the interlocking cam operating portion 5. The controlling portion 6 has a pair of tapered faces 6*a* formed thereon which are adapted to slidably engage with and press against the simultaneous locking inhibiting member.

The interlocking switch device further includes an interlocking cam 8 which has a plurality of engaging portions 8*a* formed thereon and adapted to engage with the interlocking cam operating portions 5 of the slides 3. The interlocking cam 8 is urged to slidably return in a horizontal direction to its normal position by means of a coiled spring 9.

The interlocking switch device further includes a simultaneous locking inhibiting member 10 located below the interlocking cam 8. The simultaneous locking inhibiting member 10 is in the form of a flat plate having a plurality of receiving portions 11 projectingly formed in a spaced relationship by a fixed distance on a side edge along the length thereof. A tapered face 11*a* is formed on one or both of two opposite side faces of each of the receiving portions 11 and tapered in the same angle with the tapered face 6*a* of the controlling portion 6 of the slide 3. The tapered faces 11*a* on any of the receiving portions 11 are tapered in different or opposite directions, as particularly seen from FIG. 3.

Figure 4:
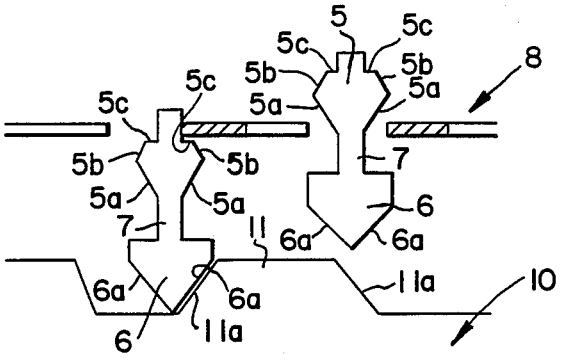
FIG. 4 is a cross sectional view showing normal operation with one switch depressed at a time.

As shown in FIG. 4, if the slide 3 of one of the switches 2 is selectively depressed, one of the tapered lowering guide faces 5*a* of the interlocking cam operating portion 5 of the slide 3 is slidably engaged with a corresponding one of the engaging portions 8*a* of the interlocking cam 8 and moves the interlocking cam 8 in one horizontal direction while the slide 3 is moved downwardly. At the same time, one of the tapered faces 6*a* of the controlling portion 6 of the slide 3 is slidably engaged with a corresponding one of the tapered faces 11*a* of a receiving portion 11 of the simultaneous locking inhibiting member 10 and moves the simultaneous locking inhibiting member 10 in one horizontal direction until the interlocking cam 8 is returned by the coiled spring 9 to its normal position in which the engaging portion 8*a* thereof engages with the corresponding stopping faces 5*c* of the slide 3 to lock the slide 3 in position. In this condition, if the slide 3 of another switch 2 is depressed, then the interlocking cam operating portion 5 of the slide 3 of the second switch 2 moves the interlocking cam 8 in the one horizontal direction so that the first switch 2 which has been locked is now released from locking and returns to its initial position while the second switch 2 is brought into a locked condition thereof in the same manner as described above.

Figure 3:
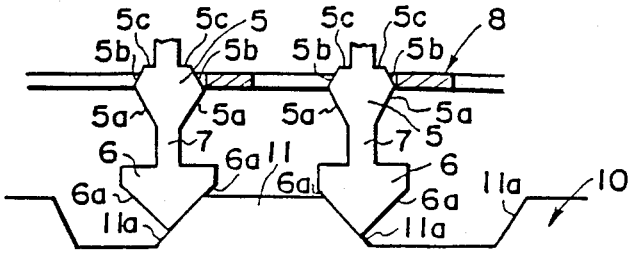
FIG. 3 is an enlarged cross sectional view illustrating a general structure of the device of FIG. 1 when a plurality of switches are depressed at a time.

However, if the slides 3 of two adjacent switches 2 are depressed at a time, tapered faces 6*a* of the controlling portions 6 thereof will press against the differently of oppositely tapered faces 11*a* of a receiving portion 11 of the simultaneous locking inhibiting member 10 from opposite sides, and hence the slides 3 will never be brought into a locked position (see FIG. 3).

It is to be noted that while in the present embodiment the simultaneous locking inhibiting member 10 is in the form of a flat plate and has a plurality of receiving portions 11 formed thereon, it may be replaced by a known arrangement including a plurality of straight bar-formed locking cams which have a tapered face and an engaging face for engagement with another cam both formed on each of opposite ends thereof and are arranged in a serial row to each other. Alternatively, the simultaneous locking inhibiting member 10 may have a plurality of receiving portions 11 formed projectingly at alternate positions on opposite side edges thereof in order to constitute a simultaneous locking inhibiting mechanism for inhibiting simultaneous locking of switches in a plurality of rows of interlocking switch devices.

As apparent from the foregoing description, according to the present invention, a slide has an interlocking cam operating portion and an inhibiting portion for a simultaneous locking inhibiting mechanism both formed on a wall face thereof. Accordingly, the thickness of the slide can be reduced, and the structure thereof can be simplified.

What is claimed is:

1. An interlocking switch device comprising:

a plurality of switches arranged spaced apart in a horizontal row each having a slide which is downwardly depressable against a biasing force, each said slide being provided with an operating portion, including a guide face and a stopping face, and a controlling portion which is spaced a first distance below the operating portion;

an interlocking cam having a plurality of engaging holes spaced apart in a row corresponding to respective ones of said slides of said switches, said interlocking cam being displaceable in a horizontal direction against a biasing force, wherein each operating portion of a slide of a respective switch is depressably engageable with a respective engaging hole of the interlocking cam such that when the slide is depressed, the guide face of the operating portion slidingly engages the engaging hole to displace the interlocking cam horizontally until the interlocking cam is returned by its biasing force to engage the stopping face of the operating portion to hold the switch in a depressed position, said switch being releasable to its original position upon depression of another switch by the operating portion of the other switch displacing said interlocking cam and disengaging it from the stopping face of the first-mentioned switch; and an inhibiting member, for preventing simultaneous depression of more than one switch at a time, formed as a flat plate which is horizontally displaceable and is spaced a second distance below the interlocking cam, said plate having a plurality of receiving portions projecting upwardly therefrom arranged in a horizontal row, each receiving portion being positioned between each adjacent pair of the switches and formed with a pair of tapered faces spaced apart a third distance on each side thereof, wherein said first, second, and third distances are arranged such that when the slide of one switch is depressed, the controlling portion thereof engages a tapered face of a corresponding receiving portion and displaces said inhibiting member horizontally, whereby another one of the switches is prevented from being depressed at the same time by blocking engagement of the controlling portion of the other switch with a tapered face of another corresponding receiving portion of the displaced inhibiting member.

2. An interlocking switch device according to claim 1, wherein said slide further has an intervening connecting portion between said interlocking cam operating portion and said controlling portion thereof.

3. An interlocking switch device according to claim 1, wherein said interlocking cam operating portion has a tapered guide face for engaging with an interlocking cam to move the interlocking cam in a horizontal direction when said slide is depressed, and a horizontal stopping face for engaging with said interlocking cam to lock the interlocking cam operating portion in a depressed position.

4. An interlocking switch device according to claim 1, wherein said controlling portion has a tapered face formed thereon for slidably engaging with said simultaneous locking inhibiting member to inhibit the slide of any other switch from being brought to its locked position.

5. An interlocking switch device according to claim 1, wherein said controlling portion has a pair of tapered faces formed thereon, one of said tapered faces of said controlling portion being disposed for engagement with said simultaneous locking inhibiting member to inhibit the slide of any other switch from being brought to its locked position.

* * * * *